US009437166B2

(12) United States Patent
Song et al.

(10) Patent No.: US 9,437,166 B2
(45) Date of Patent: Sep. 6, 2016

(54) BI-DIRECTIONAL DRIVING SCAN DRIVER

(71) Applicant: Samsung Display Co., Ltd., Yongin (KR)

(72) Inventors: Jun-Yong Song, Hwaseong-si (KR); Jae Hoon Lee, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 61 days.

(21) Appl. No.: 14/451,802

(22) Filed: Aug. 5, 2014

(65) Prior Publication Data

US 2014/0340387 A1 Nov. 20, 2014

Related U.S. Application Data

(62) Division of application No. 13/301,086, filed on Nov. 21, 2011, now abandoned.

(30) Foreign Application Priority Data

Aug. 8, 2011 (KR) ..... 10-2011-0078795

(51) Int. Cl.
*G09G 3/36* (2006.01)
*G09G 5/18* (2006.01)
*G09G 3/20* (2006.01)

(52) U.S. Cl.
CPC *G09G 5/18* (2013.01); *G09G 3/20* (2013.01); *G09G 2300/0408* (2013.01); *G09G 2310/0267* (2013.01); *G09G 2310/0283* (2013.01); *G09G 2310/0286* (2013.01); *G09G 2310/08* (2013.01)

(58) Field of Classification Search
CPC ..... G09G 2310/0286; G09G 2310/0283
USPC ..... 345/55, 98–100; 326/62, 63, 80; 327/333
See application file for complete search history.

(56) References Cited

U.S. PATENT DOCUMENTS

| | | | |
|---|---|---|---|
| 7,250,932 | B2 | 7/2007 | Jung |
| 7,420,536 | B2 | 9/2008 | Jang et al. |
| 2001/0050678 | A1 | 12/2001 | Nishikubo et al. |
| 2007/0091033 | A1 | 4/2007 | Nakamura |
| 2007/0248204 | A1 | 10/2007 | Tobita |
| 2008/0012841 | A1 | 1/2008 | Morii |
| 2010/0109996 | A1 | 5/2010 | Park et al. |
| 2010/0207927 | A1 | 8/2010 | Joo et al. |

FOREIGN PATENT DOCUMENTS

| | | |
|---|---|---|
| JP | 3870763 | 10/2006 |
| JP | 2007108457 | 4/2007 |

(Continued)

*Primary Examiner* — Ram Mistry
(74) *Attorney, Agent, or Firm* — Cantor Colburn LLP

(57) ABSTRACT

A scan driver includes stages dependently connected to each other, where each of the stages outputs a gate signal, where a first scanning start signal is input to a first stage of the stages, where a second scanning start signal is input to a last stage of the stages, where each of the first scanning start signal and the second scanning start signal has one pulse per frame, where the stages sequentially output a gate-on voltage between a time when a pulse of the first scanning start signal for a frame is input to the first stage and a time when a pulse of the second scanning start signal for the frame is input to the last stage, and where the stages output a first low voltage lower than the gate-on voltage after the pulse of the second scanning start signal for the frame is input to the last stage.

2 Claims, 13 Drawing Sheets

(56) References Cited

FOREIGN PATENT DOCUMENTS

| | | |
|---|---|---|
| JP | 2007322495 | 12/2007 |
| JP | 2010044382 | 2/2010 |
| JP | 4609970 | 10/2010 |
| KR | 1020040061210 | 7/2004 |
| KR | 1020080000746 | 1/2008 |
| KR | 1020080000770 | 1/2008 |
| KR | 1020080040448 | 5/2008 |
| KR | 100919190 | 9/2009 |
| KR | 1020100093200 | 8/2010 |

BI-DIRECTIONAL DRIVING SCAN DRIVER

This application is a divisional of U.S. application Ser. No. 13/301,086, filed on Nov. 21, 2011, which claims priority to Korean Patent Application No. 10-2011-0078795, filed on Aug. 8, 2011, and all the benefits accruing therefrom under 35 U.S.C. §119, the content of which in its entirety is herein incorporated by reference.

BACKGROUND OF THE INVENTION (a) Field of the Invention

Exemplary embodiments of the invention relate to a scan driver, a display device including the scan driver, and a driving method of the display device.

(b) Description of the Related Art

In general, a display device includes a plurality of pixels as a unit for displaying an image, and a plurality of drivers. The driver typically includes a data driver that applies a data voltage to a pixel, and a scan driver that applies a gate signal for controlling transmission of the data voltage. In a conventional display device, the scan driver and the data driver may be provided on a printed circuit board ("PCB") as a chip type and are connected to the display panel, or may be directly mounted to the display panel. However, recently, the scan driver may be integrated with the display panel in a single chip in a display device where the scan driver that does not require high mobility of the thin film transistor channel.

This scan driver includes a shift register including a plurality of stages that are dependently connected to each other, and a plurality of signal lines that transmits the driving signal. The plurality of stages sequentially output the gate signal to the respective gate lines in a predetermined sequence.

In general, in a manufacturing process of the display device, a PCB that transmits various driving signals to the display panel from the outside may be provided at one of an upper side and a lower side of the display panel. In this case, the scan driver that is integrated on the display panel may sequentially output the gate signals from the upper side to the lower side of the display panel or may sequentially output the gate signals from the lower side to the upper side of the display panel based on a portion on which the PCB is provided.

BRIEF SUMMARY OF THE INVENTION

Exemplary embodiments of the invention provide a scan driver to be driven in bi-directional driving with reduced number of stages therein.

In exemplary embodiments, the number of driving signal lines for transmitting driving signals to be applied to the scan driver is substantially reduced.

In an exemplary embodiment, a scan driver includes a plurality of stages dependently connected to each other, where each of the plurality of stages outputs a gate signal, where a first scanning start signal is input to a first stage of the plurality of stages, where a second scanning start signal is input to a last stage of the plurality of stages, where each of the first scanning start signal and the second scanning start signal has one pulse per frame, where the plurality of stages sequentially outputs a gate-on voltage between a time when a pulse of the first scanning start signal for a frame is input to the first stage and a time when a pulse of the second scanning start signal for the frame is input to the last stage, and where the plurality of stages outputs a first low voltage lower than the gate-on voltage after the pulse of the second scanning start signal for the frame is input to the last stage.

In an exemplary embodiment, the scan driver may further include a first signal line which transmits the first scanning start signal and a second signal line which transmits the second scanning start signal, where the first signal line and the second signal line receive the first scanning start signal and the second scanning start signal from an external device disposed outside the scan driver.

In an exemplary embodiment, the scan driver may be driven by bi-directional driving including a forward direction driving and a reverse direction driving.

In an exemplary embodiment, a voltage of a high level of at least one of the first pulse and the second pulse may be substantially equal to the gate-on voltage, and a voltage of a low level of at least one of the first pulse and the second pulse may be substantially equal to the first low voltage or a second low voltage lower than the first low voltage.

In an exemplary embodiment, a second stage of the plurality of stages may output a carry signal in synchronization with the gate signal to transmit the carry signal to a previous stage of the second stage or a subsequent stage of the second stage.

In an exemplary embodiment, the second stage may include a pull-up unit which outputs a high level voltage of the first clock signal as the gate-on voltage, a carry unit which outputs the high level voltage of the first clock signal as a high level voltage of the carry signal, a first pull-down unit which pulls down the gate signal as the first low voltage in response to the carry signal of the previous stage and the carry signal of the subsequent stage, a first pull-up/down controller which applies a first power source voltage in a high level to a control electrode of the pull-up unit under the forward direction driving and applies a second power source voltage in a low level to the control electrode of the pull-up unit under the reverse direction driving in response to the carry signal of the previous stage, and a second pull-up/down controller which applies the first power source voltage in a low level to the control electrode of the pull-up unit under the forward direction driving and applies the second power source voltage in a high level to the control electrode of the pull-up unit under the reverse direction driving in response to the carry signal of the subsequent stage.

In an exemplary embodiment, at least one of the high level of the first power source voltage and the high level of the second power source voltage may be substantially equal to the gate-on voltage, and at least one of the low level of the first power source voltage and the low level of the second power source voltage may be substantially equal to the second low voltage.

In an exemplary embodiment, the first stage may further include a second pull-down unit which pulls down a high level voltage of the carry signal of the first stage to the second low voltage in response to the carry signal of the previous stage and the carry signal of the subsequent stage.

In an exemplary embodiment, a second stage of the plurality of stages may include a gate output terminal which outputs the gate signal, a carry output terminal which outputs a carry signal synchronized with the gate signal, a first input terminal which receives the first scanning start signal or the carry signal of a previous stage thereof, a second input terminal which receives the second scanning start signal or the carry signal of a next stage thereof, a first low voltage terminal which receives the first low voltage, a second low voltage terminal which receives a second low voltage that is substantially equal to or less than the first low voltage, a first power source terminal which receives a first power source voltage, and a second power source terminal which receives a second power source voltage.

In an exemplary embodiment, the first power source voltage may have a level of the gate-on voltage under the forward direction driving and have a level of the second low voltage under the reverse direction driving, and the second power source voltage may have a level of the second low voltage under the forward direction driving and has a level of the gate-on voltage under the reverse direction driving.

In an exemplary embodiment, a second stage of the plurality of stages may include a low voltage terminal which receives a voltage having a level substantially the same as a level of a low level voltage of the first scanning start signal or the second scanning start signal, and the low voltage terminal receives one of the first scanning start signal and the second scanning start signal.

In an exemplary embodiment, a scan driver includes a plurality of stages dependently connected to each other, where each of the plurality of stages outputs a gate signal, where a first stage of the plurality of stages includes a first terminal which receives a first driving signal, where a waveform of the first driving signal in a first period and a waveform of the first driving signal in a second period are different from each other, and where at least one stage of the plurality of stages operates in the second period of the first driving signal input to the second terminal and does not operate in the first period of the first driving signal.

In an exemplary embodiment, the first driving signal may include a scanning start signal having one pulse per frame.

In an exemplary embodiment, a display device includes: a display panel including the plurality of gate lines; a scan driver including a plurality of stages dependently connected to each other and connected to the plurality of gate lines, respectively; and a signal controller which transmits a first scanning start signal and a second scanning start signal to the scan driver, where a first stage of the plurality of stages receives the first scanning start signal, where a last stage of the plurality of stages receives the second scanning start signal, where each of the first scanning start signal and the second scanning start signal has one pulse per frame, where the plurality of stages sequentially outputs a gate-on voltage between a time when a pulse of the first scanning start signal for a frame is input to the first stage and a time when a pulse of the second scanning start signal for the frame is input to the last stage, and where the plurality of stages outputs a first low voltage lower than the gate-on voltage after the second pulse of the second scanning start signal is input to the last stage.

In an exemplary embodiment, the scan driver may be driven by bi-directional driving including a forward direction driving and a reverse direction driving.

In an exemplary embodiment, a voltage of a high level of at least one of the first pulse and the second pulse may be substantially equal to the gate-on voltage, and a voltage of a low level of at least one of the first pulse and the second pulse may be substantially equal to the first low voltage or a second low voltage lower than the first low voltage.

In an exemplary embodiment, a method of driving a display device including a scan driver including a plurality of stages dependently connected to each other and which outputs gate signals and a signal controller which transmits a first scanning start signal and a second scanning start signal to the scan driver, where the method includes: inputting a pulse of the first scanning start signal for a frame to a first stage of the plurality of stages, the first stage being firstly positioned among the plurality of stages; inputting a pulse of the second scanning start signal for the frame to a last stage of the plurality of stages; and sequentially outputting a gate-on voltage between a time when the pulse of the first scanning start signal for the frame is input to the first stage and a time when the pulse of the second scanning start signal for the frame is input to the last stage.

In an exemplary embodiment, the method may further include outputting a first low voltage lower the gate-on voltage after the pulse of the second scanning start signal for the frame is input to the last stage of the plurality of stages.

In an exemplary embodiment, the scan driver may be driven by bi-directional driving including a forward direction driving and a reverse direction driving.

In an exemplary embodiment, the pulse of the first scanning start signal for the frame may be input to the first stage before the pulse of the first scanning start signal for the frame is input to the last stage when the scan driver is driven in the forward direction driving, and the pulse of the first scanning start signal for the frame may be input to the first stage after the pulse of the second scanning start signal for the frame is input to the last stage when the scan driver is driven in the reverse direction driving.

In an exemplary embodiment, the method may further include applying a first power source voltage and a second power source voltage to the plurality of stages, where a voltage level of the first power source voltage and a voltage level of the second power source voltage in the forward direction driving are exchanged in the reverse direction driving.

According to an exemplary embodiment of the invention, a scan driver driven by bi-directional driving may have a simple structure and an area occupied by the scan driver may be substantially reduced.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION OF THE INVENTION

Figure 1:
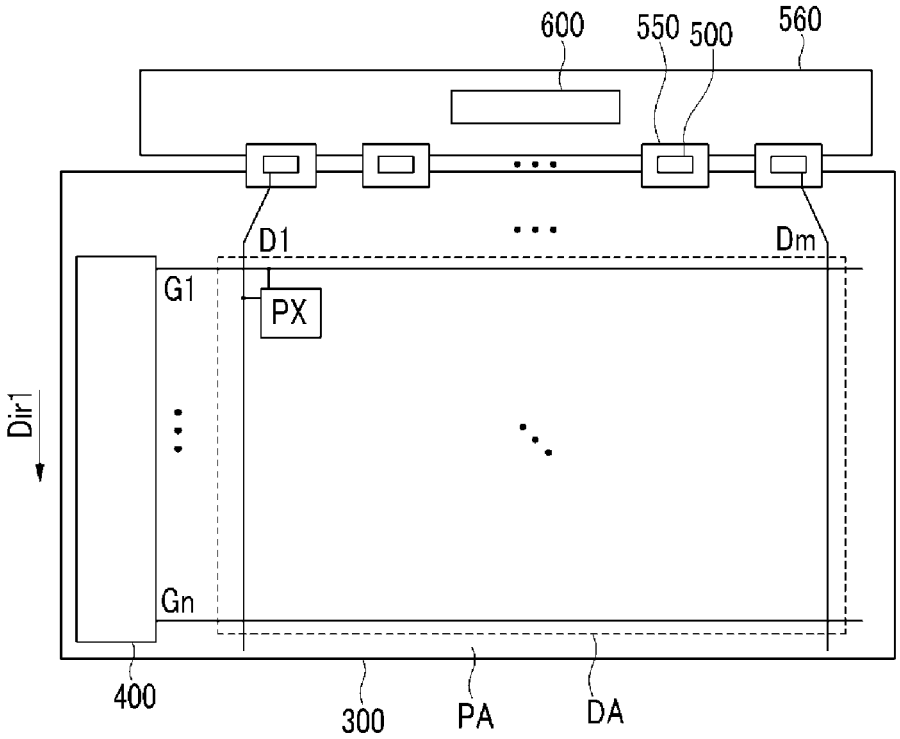
FIGS. 1 and 2 are block diagrams showing exemplary embodiments of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, an exemplary embodiment of a display device according to the invention will be described with reference to FIGS. 1 and 2.

Figure 2:
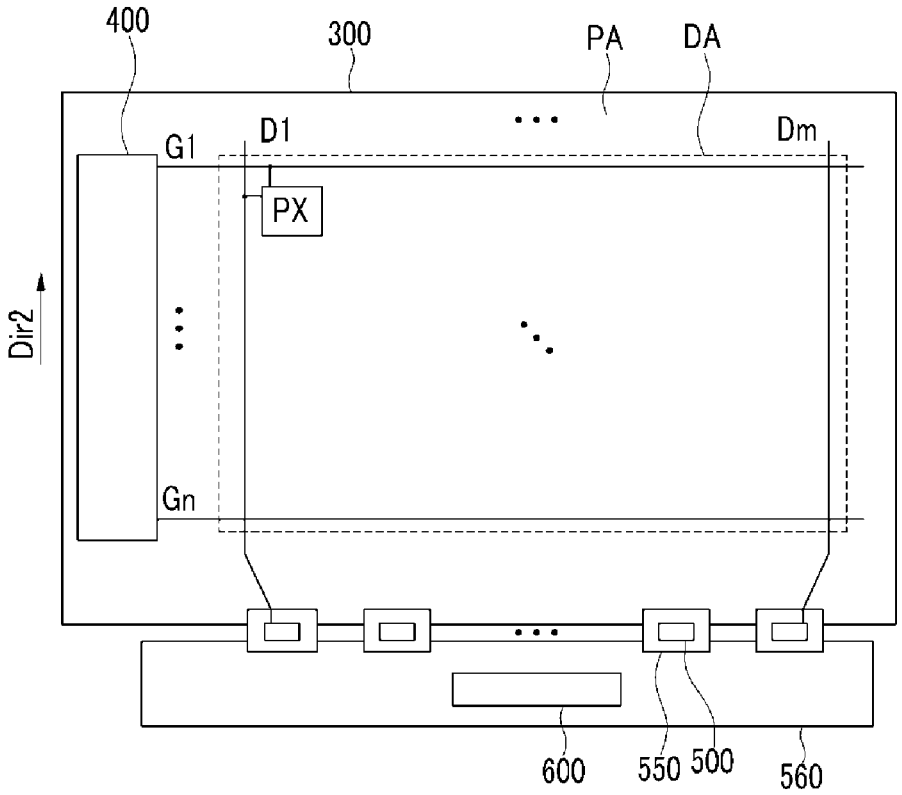

FIGS. 1 and 2 are top plan views of exemplary embodiments of a display device according to the t invention.

Referring to FIGS. 1 and 2, a display device includes a display panel 300, a scan driver 400, a data driver 500 and a signal controller 600 that controls the scan driver 400 and the data driver 500.

The display panel 300 includes a plurality of gate signal lines G1 to Gn, a plurality of data lines D1 to Dm, and a plurality of pixels PX connected to the plurality of gate signal lines G1 to Gn and a plurality of data lines D1 to Dm and arranged in a matrix form. In an exemplary embodiment, the display panel 300 includes a display area DA in which a plurality of pixels PX are arranged and a peripheral area PA at the circumference of the display area DA.

The gate signal lines G1 to Gn transmit a gate signal, and the data signal lines D1 to Dm transmit a data voltage.

Each of the pixels PX may include a switching element and a pixel electrode connected to a corresponding gate line of the gate lines G1 to Gn and a corresponding data line of the data lines D1 to Dm. In an exemplary embodiment, the switching element may be a three terminal element, such as a thin film transistor, that is integrated in the display panel 300.

The data driver 500 is connected to the data lines D1 to Dm and may include a plurality of data driving chips. The data driver 500 may be positioned on a flexible printed circuit ("FPC") film 550 attached to the display panel 300. In an exemplary embodiment, the FPC 550 electrically connects the display panel 300 to a printed circuit board ("PCB") 560. In an alternative exemplary embodiment, the data driver 500 may be directly mounted in the peripheral area PA of the display panel 300 and may be integrated in the peripheral area PA in a manufacturing process, in which the switching element included in the pixel PX is provided.

The scan driver 400 is integrated in the peripheral area PA of the display panel 300 and sequentially transmits gate signals to the gate lines G1 to Gn. The gate signal includes a gate-on voltage Von and a gate-off voltage Voff. The scan driver 400 may receive various driving signals through the PCB 560 and the FPC film 550.

The signal controller 600 may be positioned on the PCB 560. The signal controller 600 may generate a scan control signal that controls the driving of the scan driver 400 and a data control signal that controls the driving of the data driver 500, and may transmit them to the scan driver 400 and the data driver 500 through the FPC film 550. The scan control signal includes an image scanning start signal to instruct the start of image scanning and at least one clock signal to control an output cycle of the gate-on voltage, and further includes an output enable signal to define a duration of the gate-on voltage. The data control signal may include a horizontal synchronization start signal that informs the transmission start of digital image data for one column of pixels PX, a load signal that instructs the analog data voltage to be applied to the image data lines D1 to Dm, and a data clock signal.

In an exemplary embodiment, as shown in FIG. 1, the PCB 560 and the FPC film 550 may be positioned near an upper portion of the display panel 300. In an alternative exemplary embodiment, as shown in FIG. 2, the PCB 560 and the FPC film 550 may be positioned near a lower portion of the display panel 300. In an exemplary embodiment, where the PCB 560 and the FPC film 550 are positioned near the upper portion of the display panel 300, the scan driver 400 may sequentially output the gate-on voltage Von to the gate lines G1 to Gn in the first direction Dir1 (this is referred to as a forward direction driving mode). In an exemplary embodiment, where the PCB 560 and the FPC film 550 are positioned near the lower portion of the display panel 300, the scan driver 400 may sequentially output the gate-on voltage Von to the gate lines G1 to Gn in the second direction Dir2 (this is referred to as a reverse direction driving mode). The first direction Dir1 and the second direction Dir2 are opposite to each other, and the two directions may be perpendicular to a direction, along which the gate lines G1 to Gn extend, that is, a column direction.

Next, a structure and a driving method of the scan driver 400 will be described with reference to FIGS. 1 to 5.

Figure 3:
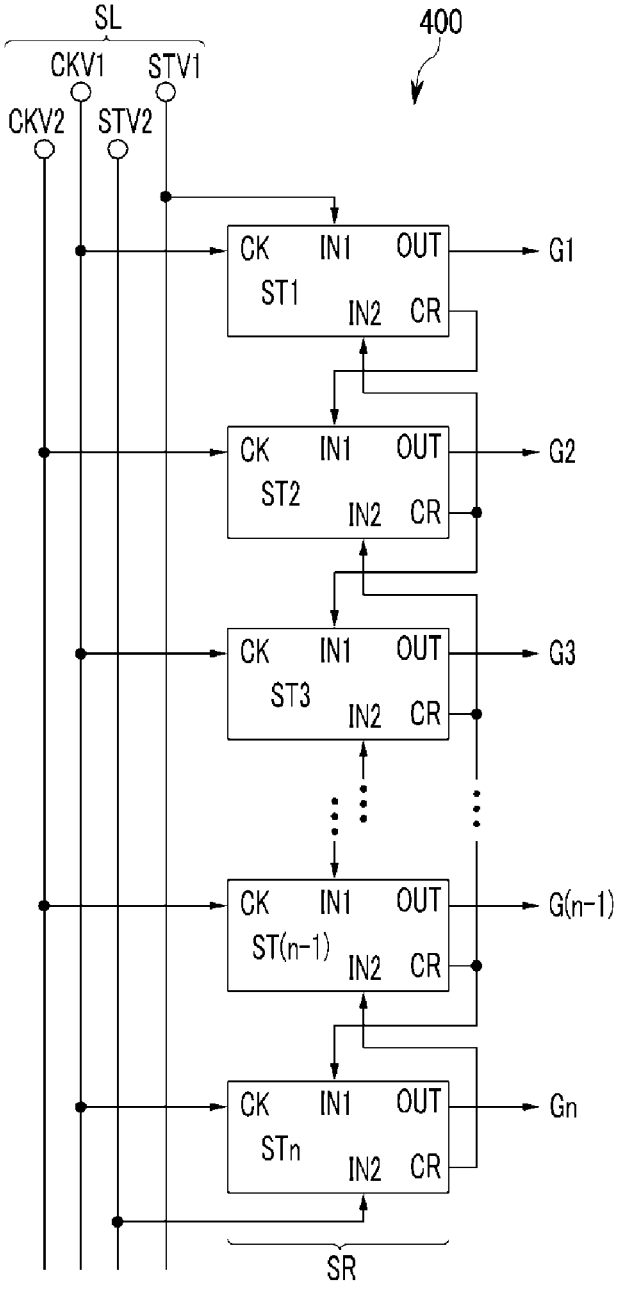
FIG. 3 is a block diagram showing an exemplary embodiment of a scan driver according to the invention.
Figure 4:
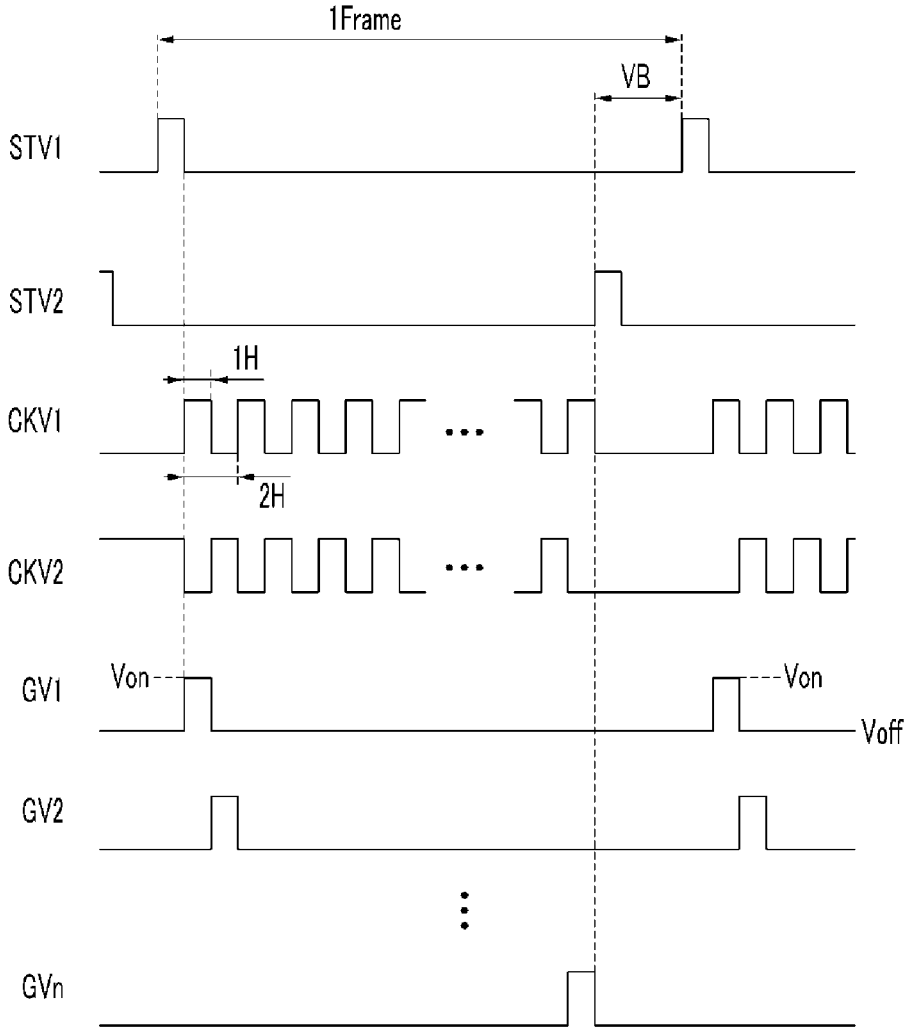
FIG. 4 is a signal timing diagram of a driving signal and a gate signal when the scan driver shown in FIG. 3 is driven in the first direction driving mode.
Figure 5:
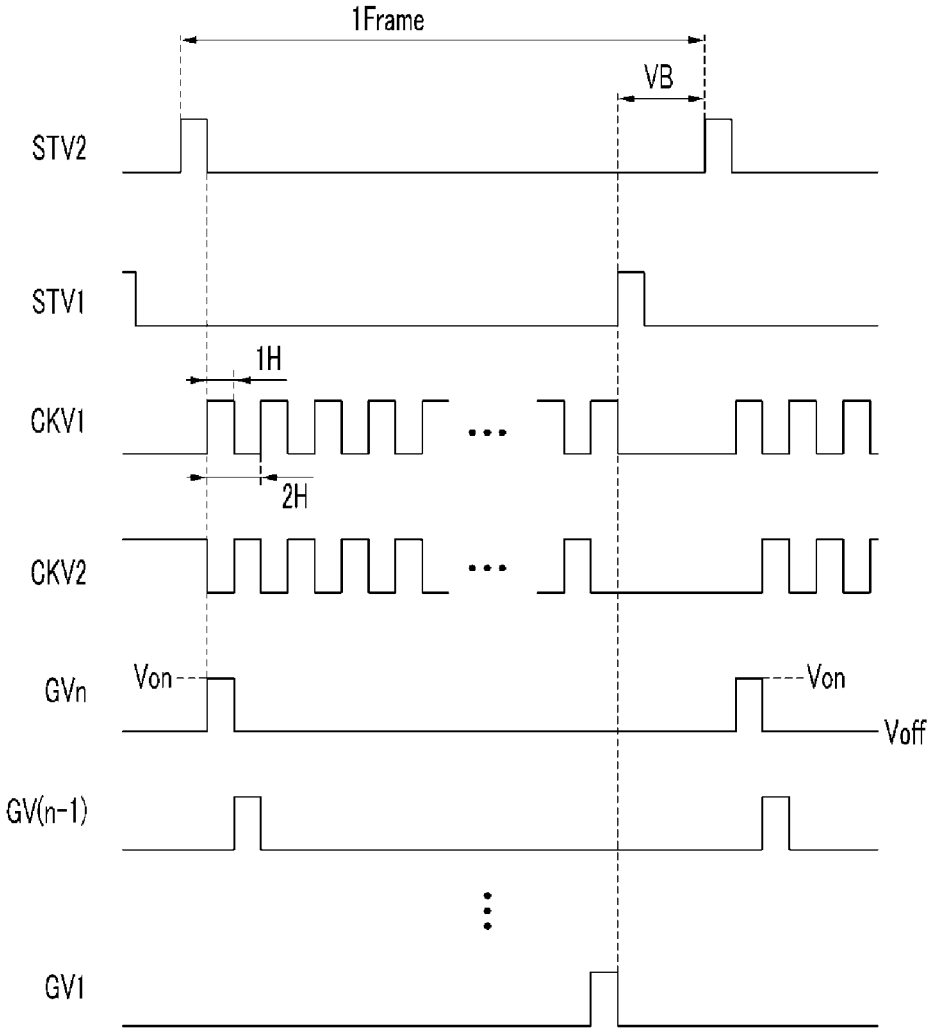
FIG. 5 is a signal timing diagram of a driving signal and a gate signal when the scan driver shown in FIG. 3 is driven in the second direction driving mode.

FIG. 3 is a block diagram showing an exemplary embodiment of a scan driver according to the invention, FIG. 4 is a signal timing diagram of a driving signal and a gate signal when the scan driver shown in FIG. 3 is driven in the first direction driving mode, and FIG. 5 is a signal timing diagram of a driving signal and a gate signal when the scan driver shown in FIG. 3 is driven in the second direction driving mode.

Referring to FIG. 3, a scan driver includes a driving wiring unit SL and a shift register unit SR electrically connected thereto.

The driving wiring unit SL may transmit a plurality of driving signals. In an exemplary embodiment, the driving wiring unit SL includes a line that transmits a first scanning start signal STV1, a line that transmits a second scanning start signal STV2, a line that transmits a first clock signal CKV1, and a line that transmits a second clock signal CKV2. The driving wiring unit SL may receive the driving signals through the PCB 560 and the FPC film 550 shown in FIGS. 1 and 2.

Referring to FIGS. 4 and 5, each of the first scanning start signal STV1 and the second scanning start signal STV2 may be a pulse signal having one pulse per frame. A pulse application time of the first scanning start signal STV1 and a pulse application time of the second scanning start signal STV2 may be different from each other. In an exemplary embodiment, a time difference between the pulse application time of the first scanning start signal STV1 and the pulse application time of the second scanning start signal STV2 may be less than a time interval of one frame.

In an exemplary embodiment, when a period in which the data voltages are not output to the data lines D1 to Dm of the display panel 300 between two neighboring frames is referred to as a vertical blank period VB, an interval between the pulse of the first vertical start signal STV1 of a frame and the pulse of the second vertical start signal STV2 of a neighboring frame may be substantially equal to the vertical blank period VB. The pulse of the first scanning start signal STV1 or the second scanning start signal STV2 may have a high level corresponding to the gate-on voltage Von and a low level corresponding to a predetermined low voltage or the gate-off voltage Voff.

The first clock signal CKV1 may be a pulse signal repeating periodically at a period of 2H (where H=horizontal scan frequency) and having the gate-on voltage Von as a high level thereof and the predetermined low voltage or the gate-off voltage Voff as a low voltage thereof. A duty ratio of the pulse of the first clock signal CKV1 may be equal to or less than about 50%.

The second clock signal CKV2 may be the pulse signal of which the phase of the first clock signal CKV1 is reversed. In an alternative exemplary embodiment, the line that transmits the second clock signal CKV2 may be omitted.

Referring to FIGS. 4 and 5, the first clock signal CKV1 and the second clock signal CKV2 may maintain a predetermined voltage in the vertical blank period VB, for example, the low voltage such as the gate-off voltage Voff.

In an exemplary embodiment, the driving wiring unit SL may further include a signal line that transmits a direct current ("DC") voltage having a predetermined voltage in each driving mode.

The shift register unit SR includes a plurality of stages ST1, ST2, ST3, . . . , ST(n−1) and STn that are dependently connected to each other. The stages ST1, ST2, ST3, . . . , ST(n−1) and STn are respectively connected to the gate lines G1 to Gn, such that the gate signal is outputted to the gate lines G1 to Gn. Each of the stages ST1, ST2, ST3, . . . , ST(n−1) and STn may include a plurality of thin film transistors and capacitors that are integrated in the peripheral area PA of the display panel 300.

Each of the stages ST1, ST2, ST3, . . . , ST(n−1) and STn includes a clock terminal CK, a first input terminal IN1, a second input terminal IN2, a carry output terminal CR and a gate output terminal OUT.

The clock terminal CK of each of the stages ST1, ST2, ST3, . . . , ST(n−1), and STn receives the first clock signal CKV1 or the second clock signal CKV2. In one exemplary embodiment, for example, the clock terminals CK of an odd-numbered stage may receive the first clock signal CKV1 and the clock terminals CK of an even-numbered stage may receive the second clock signal CKV2.

The gate output terminals OUT of the stages ST1, ST2, ST3, . . . , ST(n−1) and STn respectively output the gate signal GV1 to GVn. The gate output terminals OUT of the stages ST1, . . . , and STn are respectively electrically connected to the gate lines G1 to Gn to transmit the gate signals GV1 to GVn. The gate signals GV1 to GVn may include the gate-on voltage Von and the gate-off voltage Voff.

The carry output terminals CR of the stages ST1, ST2, ST3, . . . , ST(n−1) and STn output the carry signal. The carry signal may be a signal that is synchronized with the gate signal.

The carry signal output from the carry output terminal CR of a stage may be input to the second input terminal IN2 of a previous stage of the stage and the first input terminal IN1 of a subsequent stage of the stage. In one exemplary embodiment, for example, a previous stage of the k-th stage STk may be one of the stages ST1, . . . , and ST(k−1) that are positioned before the k-th stage STk, and a subsequent stage of the k-th stage STk may be one of the stages ST(k+1), . . . , and STn that are positioned subsequent to the k-th stage STk. In an exemplary embodiment, as shown in FIG. 3, the carry signal output from the carry output terminal CR of the stages ST1, ST2, ST3, . . . , ST(n−1) and STn is transmitted to the first input terminal IN1 of an immediately subsequent stage thereof or the second input terminal IN2 of an immediately previous stage thereof. The carry output terminal CR of the first stage ST1 may transmit the carry signal only to the first input terminal IN1 of the subsequent stage thereof, and the carry output terminal CR of the n-th stage STn, which is the last stage, may transmit the carry signal only to the second input terminal IN2 of the previous stage thereof.

The first input terminal IN1 of the first stage ST1 receives the first scanning start signal STV1, and the second input terminal IN2 of the last stage STn receives the second scanning start signal STV2.

Although not shown in FIG. 3, the stages ST1 to STn may further include at least one input terminal that receives at least one predetermined voltage. In an exemplary embodiment, the at least one predetermined voltage may be a direct current ("DC") voltage.

Now, a driving method of the scan driver shown in FIGS. 3 to 5 will be described.

In an exemplary embodiment, the scan driver 400 may be driven in two directions as described above.

Referring to FIG. 4, in the forward direction driving mode, when the first scanning start signal STV1 input to the first input terminal IN1 of the first stage ST1 is in the high level, the scan operation of a frame starts. The first scanning start signal STV1 of a frame becomes the high level before the second scanning start signal STV2 of the frame becomes the high level.

When the first scanning start signal STV1 input to the first input terminal IN1 of the first stage ST1 becomes the high level, that is, the first input terminal IN1 receives the pulse of the first scanning start signal STV1, the stages ST1 to STn of the shift register unit SR are sequentially driven downwardly from the first stage ST1 such that the gate signals GV1 to GVn may be sequentially output to the gate lines G1 to Gn through the gate output terminal OUT. The time at which the gate-on voltage Von is output to the first gate line G1 may be positioned between the time at which the first scanning start signal STV1 becomes the high level and the time at which the first scanning start signal STV1 becomes the low level.

In the illustrated exemplary embodiment of FIG. 4, the gate-on voltage Von is output to the gate line G1 to Gn with the cycle of 1 H, but not being limited thereto. In one exemplary embodiment, for example, the output time of the gate-on voltage Von of the gate signals GV1 to GVn may partially overlap each other, the gate signals GV1 to GVn may include two gate-on pulses per frame, and the output sequence of the gate-on voltage Von for the gate lines G1 to Gn may vary. In an exemplary embodiment, where the first stage ST1 is firstly driven and the last stage STn is finally driven, the forward direction driving mode of the scan driver may be performed by a conventional forward direction driving method.

In an exemplary embodiment, when the gate-on voltage Von is sequentially output to all of the gate lines G1 to Gn and the second scanning start signal STV2 input to the second input terminal IN2 of the last stage STn becomes the high level, the scanning of one frame is finished. In such an embodiment, when the pulse of the second scanning start signal STV2 is applied to the second input terminal IN2 of the last stage STn, the gate-off voltage Voff is output to the last gate line Gn. After the gate-on voltage Von is output to the last gate line Gn, the vertical blank period VB is progressed, and the scan operation of a next frame may start.

As shown in FIG. 5, in an exemplary embodiment under the reverse direction driving mode, the scan operation of one frame starts when the second scanning start signal STV2 input to the second input terminal IN2 of the last stage STn becomes the high level. In the reverse direction driving mode, the second scanning start signal STV2 of a frame becomes the high level before the first scanning start signal STV1 of the frame becomes the high level.

When the second scanning start signal STV1 input to the second input terminal IN2 of the last stage STn becomes the high level, the stages ST1 to STn of the shift register unit SR are sequentially driven upwardly from the last stage STn such that the gate-on voltage Von may be sequentially output to the gate lines G1 to Gn. The gate signals GV1 to GVn output to the gate lines G1 to Gn may be substantially the same as the gate signals GV1 to GVn output to the gate lines G1 to Gn shown in FIG. 4.

The reverse direction driving mode of the scan driver may be performed by a conventional reverse direction driving method where the last stage STn is firstly driven and first stage ST1 is finally driven.

In an exemplary embodiment, when the gate-on voltage Von is sequentially output to all of the gate lines G1 to Gn from the lower portion of the display panel 300 and the first scanning start signal STV1 input to the first input terminal IN1 of the first stage ST1 becomes the high level, the scan operation of a frame is finished. The vertical blank period VB of one frame is progressed after the gate-on voltage Von is output to the first gate line G1, and the scan operation of the next frame may start.

In an exemplary embodiment of the invention, different scanning start signals, e.g., the first scanning start signal STV1 and the second scanning start signal STV2, are input to the first stage ST1 and the last stage STn of the shift register of the scan driver 400 that may be driven in two directions such that the scan start and the scan finish for one frame may be controlled. In such an embodiment, the stages ST1 to STn sequentially output the gate-on voltage Von in the forward direction or the reverse direction at a time between the time when the pulse of the first scanning start signal STV1 is input to the first stage ST1 and the time when the pulse of the second scanning start signal STV2 is input to the last stage STn. In such an embodiment, a dummy stage to finish the operation of the last stage STn may be omitted, and a dummy stage to finish the operation of the first stage when the scan is started from the last stage under the bi-direction driving mode may be omitted. In such an embodiment, when the dummy stages are omitted, the area that the scan driver 400 occupies is substantially reduced and an efficient and simple scan driver is thereby provided.

Next, alternative exemplary embodiments of the scan driver 400 of the display device will be described with reference to FIGS. 6 to 9. The same or like elements shown in FIGS. 6 to 9 have been labeled with the same reference characters as used above to describe the exemplary embodiments of the scan driver shown in FIGS. 1 and 2, and any repetitive detailed description thereof will hereinafter be omitted or simplified.

Figure 6:
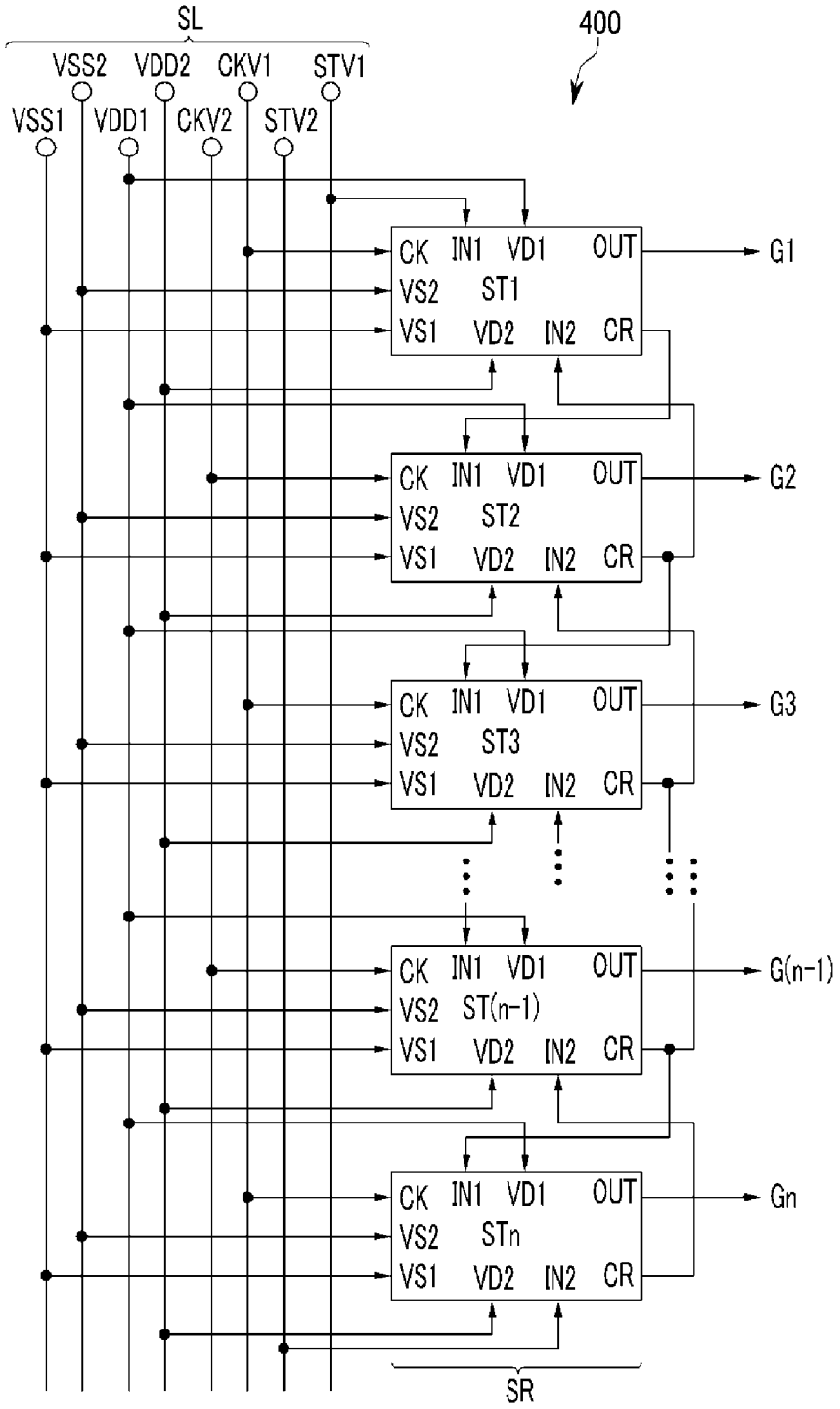
FIG. 6 is a block diagram showing an alternative exemplary embodiment of a scan driver according to the invention.
Figure 7:
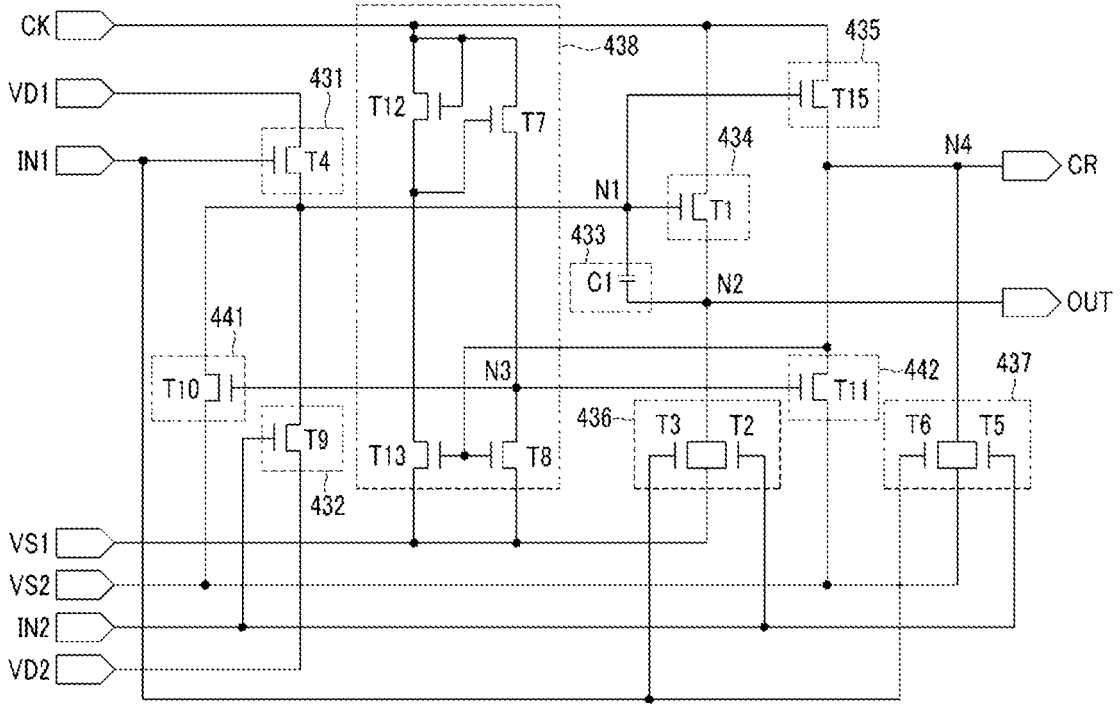
FIG. 7 is a circuit diagram showing an exemplary embodiment of a stage of a scan driver according to the invention.
Figure 8:
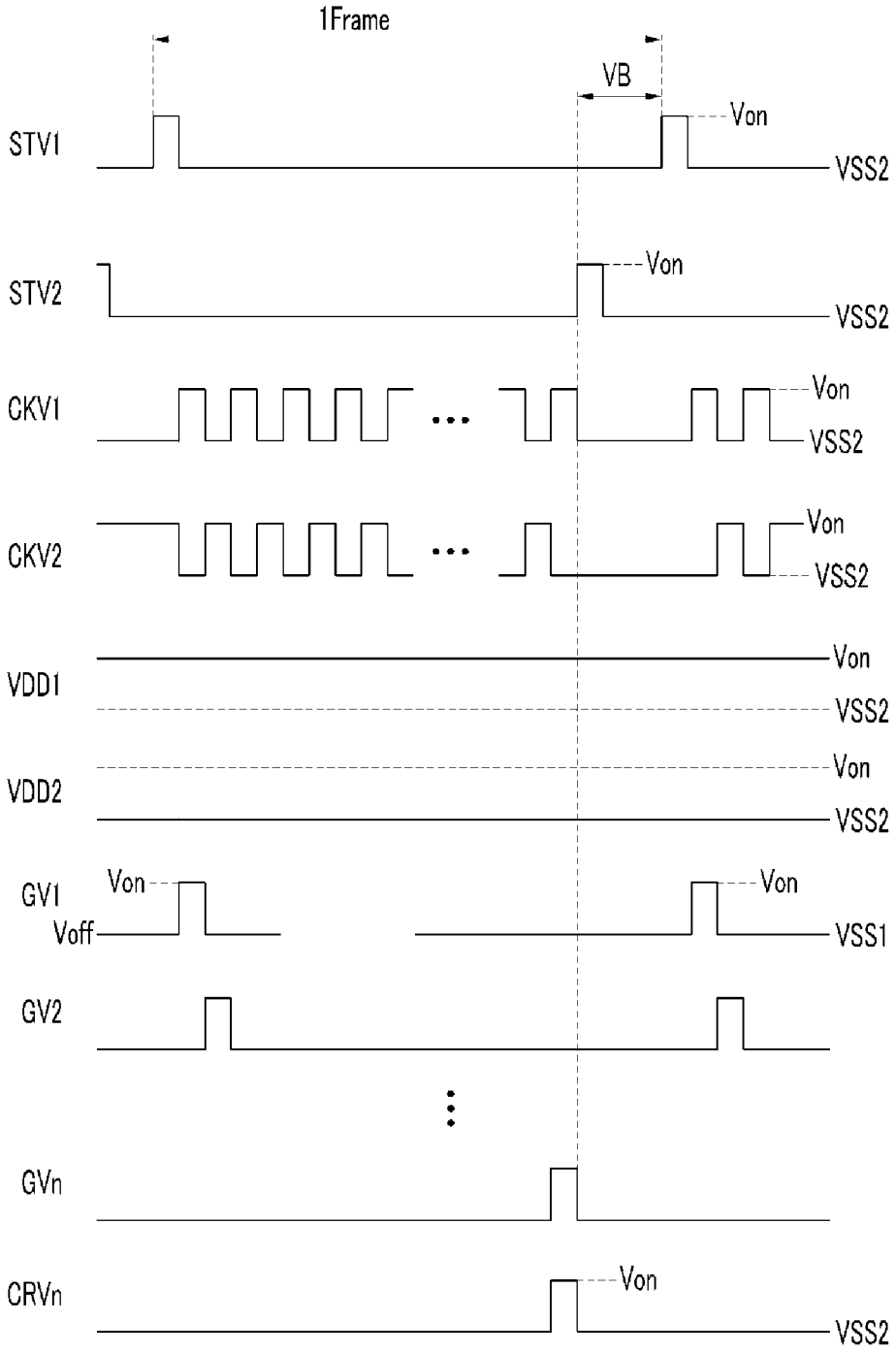
FIG. 8 is a signal timing diagram of a driving signal and a gate signal when the scan driver shown in FIG. 6 is driven in the first direction driving mode.
Figure 9:
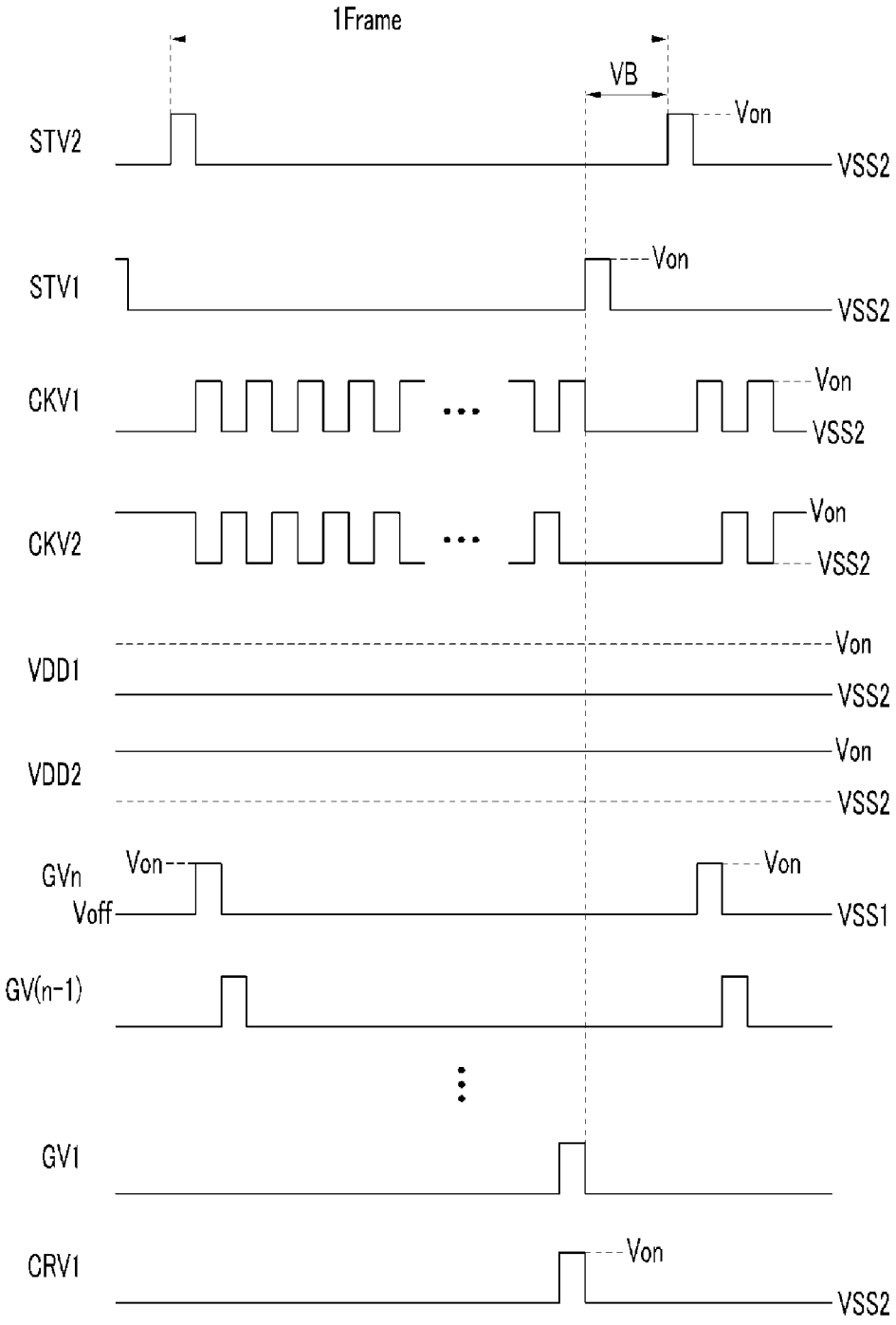
FIG. 9 is a signal timing diagram of a driving signal and a gate signal when the scan driver shown in FIG. 6 is driven in the second direction driving mode.

FIG. 6 is a block diagram showing an alternative exemplary embodiment of a scan driver according to the present invention, FIG. 7 is a circuit diagram of an exemplary embodiment of one stage of a scan driver according to f the invention, FIG. 8 is a signal timing diagram of a driving signal and a gate signal when the scan driver shown in FIG. 6 is driven in the first direction driving mode, and FIG. 9 is a signal timing diagram of a driving signal and a gate signal when the scan driver shown in FIG. 6 is driven in the second direction driving mode.

Referring to FIG. 6, a scan driver includes a driving wiring unit SL and a shift register unit SR electrically connected thereto.

The driving wiring unit SL may further include a line that transmits the first low voltage VSS1, a line that transmits the second low voltage VSS2, a line that transmits the first power source voltage VDD1, and a line that transmits the second power source voltage VDD2 as well as the line that transmits the first scanning start signal STV1, the line that transmits the second scanning start signal STV2, the line that transmits the first clock signal CKV1, and the line that transmits the second clock signal CKV2.

The first low voltage VSS1 and the second low voltage VSS2 may have different voltage levels, and each of the first low voltage VSS1 and the second low voltage VSS2 may have a predetermined voltage level. The first low voltage VSS1 may be higher than the second low voltage VSS2 and lower than the gate-on voltage Von. In an exemplary embodiment, for example, the first low voltage VSS1 may be about −7 volts (V) and the second low voltage VSS2 may be about −10 V. In an alternative exemplary embodiment, the first low voltage VSS1 and the second low voltage VSS2 may be substantially the same.

The first power source voltage VDD1 and the second power source voltage VDD2 as the DC voltage may have different voltage levels.

The first power source voltage VDD1 may have a voltage level higher than the second power source voltage VDD2 in the forward direction driving mode and a voltage level lower than the second power source voltage VDD2 in the reverse direction driving mode. In an exemplary embodiment, the first power source voltage VDD1 may be the gate-on voltage Von in the forward direction driving mode and may be the second low voltage VSS2 in the reverse direction driving mode. In an exemplary embodiment, the second power source voltage VDD2 may be the second low voltage VSS2 in the forward direction driving mode and may be the gate-on voltage Von in the reverse direction driving mode.

In an exemplary embodiment, the gate-on voltage Von may be about 22 V.

The shift register unit SR is substantially the same as the shift register unit shown in FIG. 3 except the number of input terminals. Here, the input terminals included in the stages ST1, ST2, ST3, . . . , ST(n−1), and STn will be described.

The stages ST1, ST2, ST3, . . . , ST(n−1), and STn further include the first power source terminal VD1, a second power source terminal VD2, a first low voltage terminal VS1 and a second low voltage terminal VS2 in addition to the clock terminal CK, the first input terminal IN1, the second input terminal IN2, carry output terminal CR and the gate output terminal OUT.

The first power source terminal VD1 receives the first power source voltage VDD1. As shown in FIGS. 8 and 9, the first power source voltage VDD1 input to the first power source terminal VD1 may be the gate-on voltage Von in the forward direction driving mode and may be the second low voltage VSS2 in the reverse direction driving mode.

The second power source terminal VD2 receives the second power source voltage VDD2. As shown in FIGS. 8 and 9, the second power source voltage VDD2 input to the second power source terminal VD2 may be the second low voltage VSS2 in the forward direction driving mode and may be the gate-on voltage Von in the reverse direction driving mode.

The first low voltage terminal VS1 receives the first low voltage VSS1. The first low voltage VSS1 may be substantially the same as the gate-off voltage Voff.

The second low voltage terminal VS2 receives the second low voltage VSS2.

Any repetitive detailed description of the other terminals, described above referring to FIGS. 3 to 5, will hereinafter be omitted.

Referring to FIG. 7, each of the stages ST1 to STn of the scan driver 400 includes a first pull-up/down controller 431, a second pull-up/down controller 432, a charging unit 433, a pull-up unit 434, a carry unit 435, a first pull-down unit 436, a second pull-down unit 437, an inverting unit 438, a first storage unit 441 and a second storage unit 442.

The first pull-up/down controller 431 includes a fourth transistor T4. The fourth transistor T4 includes a control electrode connected to the first input terminal IN1, an input electrode connected to the first power source terminal VD1, and an output electrode connected to a first node N1. The first node N1 is connected to a control electrode of a first transistor T1 in the pull-up unit 434. The first pull-up/down controller 431 applies the first power source voltage VDD1 to the first node N1 in response to the carry signal of the previous stage input to the first input terminal IN1 or the high level of the first scanning start signal STV1 or the second scanning start signal STV2, for example, the gate-on voltage Von. The first pull-up/down controller 431 applies the gate-on voltage Von to the first node N1 in the forward direction driving mode, and applies the low level to the first node N1 in the reverse direction driving mode, for example, the second low voltage VSS2.

The second pull-up/down controller 432 includes a ninth transistor T9. The ninth transistor T9 includes a control electrode connected to the second input terminal IN2, an input electrode connected to the second power source terminal VD2, and an output electrode connected to the first node N1. The second pull-up/down controller 432 applies the second power source voltage VDD2 to the first node N1 in response to the carry signal of the next stage applied to the second input terminal IN2 or the high level of the first scanning start signal STV1 or the second scanning start signal STV2, for example, the gate-on voltage Von. The second pull-up/down controller 432 applies the second low voltage VSS2 to the first node N1 in the forward direction driving mode, and applies the gate-on voltage Von to the first node N1 in the reverse direction driving mode.

The charging unit 433 includes a capacitor C1. The capacitor C1 includes a first electrode connected to the control electrode of the pull-up unit 434 and a second electrode connected to a second node N2. The second node N2 is connected to the output electrode of the pull-up unit 434.

The pull-up unit 434 includes the first transistor T1. The first transistor T1 includes the control electrode connected to the first node N1, an input electrode connected to the clock terminal CK, and an output electrode connected to the second node N2. In a state where the charging voltage of the charging unit 433 is applied to the control electrode of the pull-up unit 434, when the gate-on voltage Von as the high level of the first clock signal CKV1 or the second clock signal CKV2 is applied to the clock terminal CK, the pull-up unit 434 is bootstrapped. At this time, the voltage applied to the first node N1 is boosted, and the pull-up unit 434 outputs the gate-on voltage Von of the first clock signal CKV1 or the second clock signal CKV2 through the gate output terminal OUT as the gate signals GV1 to GVn.

The carry unit 435 includes a fifteenth transistor T15. The fifteenth transistor T15 includes a control electrode connected to the first node N1, an input electrode connected to the clock terminal CK, and an output electrode connected to a fourth node N4. When the signal of the first node N1 is boosted, the carry unit 435 outputs the high level of the first clock signal CKV1 or the second clock signal CKV2 to the clock terminal CK, for example, the gate-on voltage Von, as the carry signal through the carry output terminal CR.

The first pull-down unit 436 includes a second transistor T2 and a third transistor T3. The second transistor T2 includes a control electrode connected to the second input terminal IN2, an input electrode connected to the second node N2, and an output electrode connected to the first low voltage terminal VS1 that receives the first low voltage VSS1. The third transistor T3 includes a control electrode connected to the first input terminal IN1, an input electrode connected to the second node N2, and an output electrode connected to the first low voltage terminal VS1. The first pull-down unit 436 pulls down the voltage of the second node N2 to the first low voltage VSS1 in response to the carry signal of the previous stage and the carry signal of the next stage. That is, the gate-on voltage Von, as the high level of the gate signal GV1 to GVn, is pulled down to the first low voltage VSS1.

The second pull-down unit 437 includes a fifth transistor T5 and a sixth transistor T6. The fifth transistor T5 includes a control electrode connected to the second input terminal IN2, an input electrode connected to the fourth node N4, and an output electrode connected to the second low voltage terminal VS2 receiving the second low voltage VSS2. The sixth transistor T6 includes a control electrode connected to the first input terminal IN1, an input electrode connected to the fourth node N4, and an output electrode connected to the second low voltage terminal VS2. The second pull-down unit 437 pulls-down the voltage of the fourth node N4 to the second low voltage VSS2 in response to the carry signal of the previous stage and the carry signal of the next stage. That is, the second pull-down unit 437 pulls down the high level of the carry signal to the second low voltage VSS2.

The inverting unit 438 includes a twelfth transistor T12, a seventh transistor T7, a thirteenth transistor T13 and an eighth transistor T8. The twelfth transistor T12 includes a control electrode and an input electrode connected to the clock terminal CK, and an output electrode connected to an input electrode of the thirteenth transistor T13 and a control electrode of the seventh transistor T7. The seventh transistor T7 includes an input electrode connected to the clock terminal CK and an output electrode connected to an input electrode of the eighth transistor T8. The output electrode of the seventh transistor T7 is connected to the third node N3. The inverting unit 438 controls the voltage applied to the third node N3. The inverting unit 438 applies the signal in synchronization with the first clock signal CKV1 or the second clock signal CKV2 received to the clock terminal CK to the third node N3, and the eighth and thirteenth transistors T8 and T13 are turned on such that the voltage of the third node N3 is discharged to the first low voltage VSS1 when the fourth node N4 is applied with the gate-on voltage Von.

The first storage unit 441 includes a tenth transistor T10. The tenth transistor T10 includes a control electrode connected to the third node N3, an input electrode connected to the first node N1, and an output electrode connected to the second low voltage terminal VS2. The first storage unit 441 discharges the voltage of the first node N1 to the second low voltage VSS2 in response to the high level applied to the third node N3, for example, the gate-on voltage Von.

The second storage unit 442 includes an eleventh transistor T11. The eleventh transistor T11 includes a control electrode connected to the third node N3, an input electrode connected to the fourth node N4, and an output electrode connected to the second low voltage terminal VS2. The second storage unit 442 discharges the voltage of the fourth node N4 to the second low voltage VSS2 in response to the high level of the third node N3, for example, the gate-on voltage Von.

The driving method of the scan driver shown in FIGS. 6 and 7 will now be described with reference to FIGS. 8 and 9.

In such an embodiment, the scan driver 400 may be driven in two directions.

Referring to FIG. 8, in the forward direction driving mode, the first power source voltage VDD1 is the gate-on voltage Von, and the second power source voltage VDD2 maintains the second low voltage VSS2.

The scan operation of a frame starts when the first scanning start signal STV1 input to the first input terminal IN1 of the first stage ST1 becomes the high level. When the first scanning start signal STV1 input to the first input terminal IN1 of the first stage ST1 becomes the high level, the stages ST1 to STn of the shift register unit SR are sequentially driven downwardly from the first stage ST1 such that the gate signals GV1 to GVn of the gate-on voltage Von may be output to the gate lines G1 to Gn through the gate output terminal OUT. In such an embodiment, the gate signals GV1 to GVn output to the gate lines G1 to Gn may be substantially the same as the gate signals GV1 to GVn output to the gate lines G1 to Gn shown in FIGS. 3 to 5.

The stages ST1 to STn generate the carry signal in synchronization with the first clock signal CKV1 or the second clock signal CKV2 in response thereto when the first scanning start signal STV1 or the carry signal of the previous stage is input through the first input terminal IN1 thereof. The carry signal output from the stages ST1 to STn may be synchronized with the gate signal output therefrom. FIG. 8 shows an exemplary embodiment of the carry signal CRVn output from the n-th stage STn.

The pulse of the first scanning start signal STV1 or the second scanning start signal STV2 may not overlap or may partially overlap the pulse of the first clock signal CKV1 or the second clock signal CKV2, as shown in FIGS. 8 and 9. In the illustrated exemplary embodiment shown in FIG. 8, when the voltage level of the first scanning start signal STV1 is in the high level, the gate-on voltage Von may start to be applied to the first gate line G1.

When the gate-on voltage Von is sequentially output to all of the gate lines G1 to Gn, and the second scanning start signal STV2 input to the second input terminal IN2 of the last stage STn becomes the high level, the scan operation of the frame is finished. After the gate-on voltage Von is output to the last gate line Gn, the vertical blank period VB may progress and the scan operation of the next frame may start.

Next, referring to FIG. 9, in the reverse direction driving mode, the first power source voltage VDD1 is the second low voltage VSS2, and the second power source voltage VDD2 maintains the gate-on voltage Von of the high level.

In the reverse direction driving mode, the scan operation of a frame starts when the second scanning start signal STV2 input to the second input terminal IN2 of the last stage STn becomes the high level. When the second scanning start signal STV1 input to the second input terminal IN2 of the last stage STn becomes the high level, the stages ST1 to STn of the shift register unit SR are sequentially driven upwardly from the last stage STn such that the gate signals GV1 to GVn may be sequentially output to the gate lines G1 to Gn. The reverse direction driving mode of the scan driver may include all scan driving methods that are obvious to a person of ordinary skill in this field if the last stage STn is firstly driven and the first stage ST1 is finally driven.

The stages ST1 to STn generate the carry signal in synchronized with the first clock signal CKV1 or the second clock signal CKV2 in response thereto when the carry signal of the next stage or the second scanning start signal STV1 is input to the second input terminal IN2. FIG. 9 shows an exemplary embodiment of the carry signal CRV1 output from the first stage ST1.

When the gate-on voltage Von is sequentially output to all gate lines G1 to Gn and the first scanning start signal STV1 input to the first input terminal IN1 of the first stage ST1 becomes the high level, the scan operation of the frame is finished. After the gate-on voltage Von is output to the first gate line G1, the vertical blank period VB is progressed and the scan operation of the next frame may be started.

Other features of the illustrated exemplary embodiment may be substantially similar to the exemplary embodiment shown in FIGS. 3 to 5.

Next, alternative exemplary embodiments of a scan driver according to the invention will be described with reference to FIGS. 10 to 13. The same or like elements shown in FIGS. 10 to 13 have been labeled with the same reference characters as used above to describe the exemplary embodiments of the scan driver shown in FIGS. 1 to 9, and any repetitive detailed description thereof will hereinafter be omitted or simplified.

Figure 10:
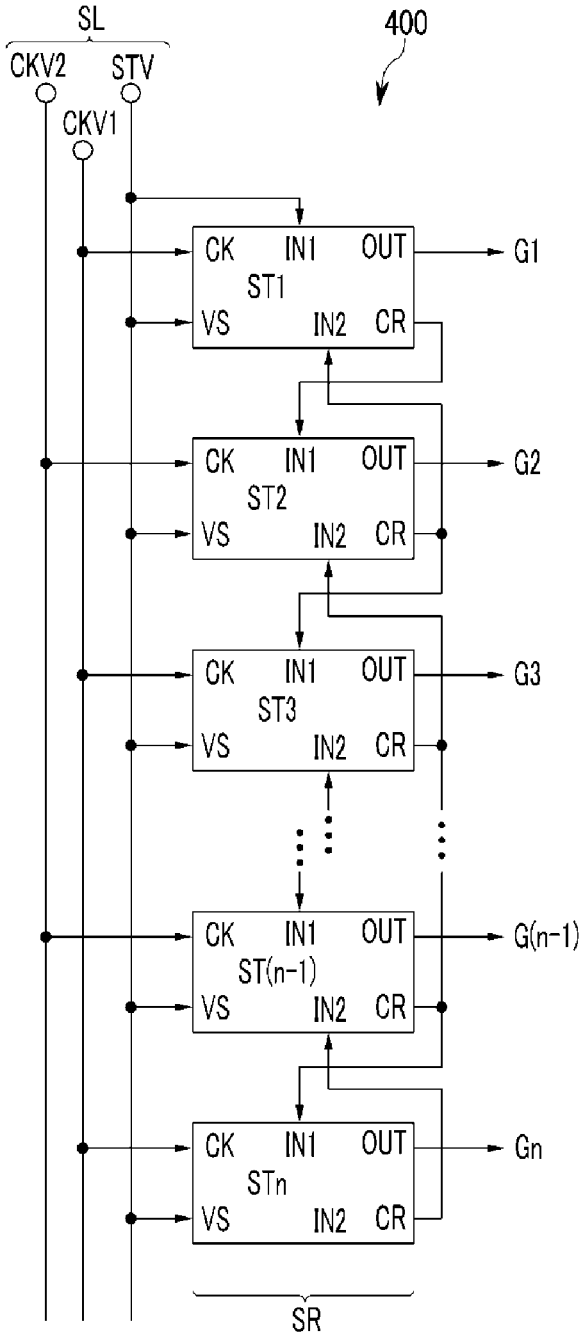
FIGS. 10 to 12 are block diagrams showing alternative exemplary embodiments of a scan driver according to the invention.
Figure 11:
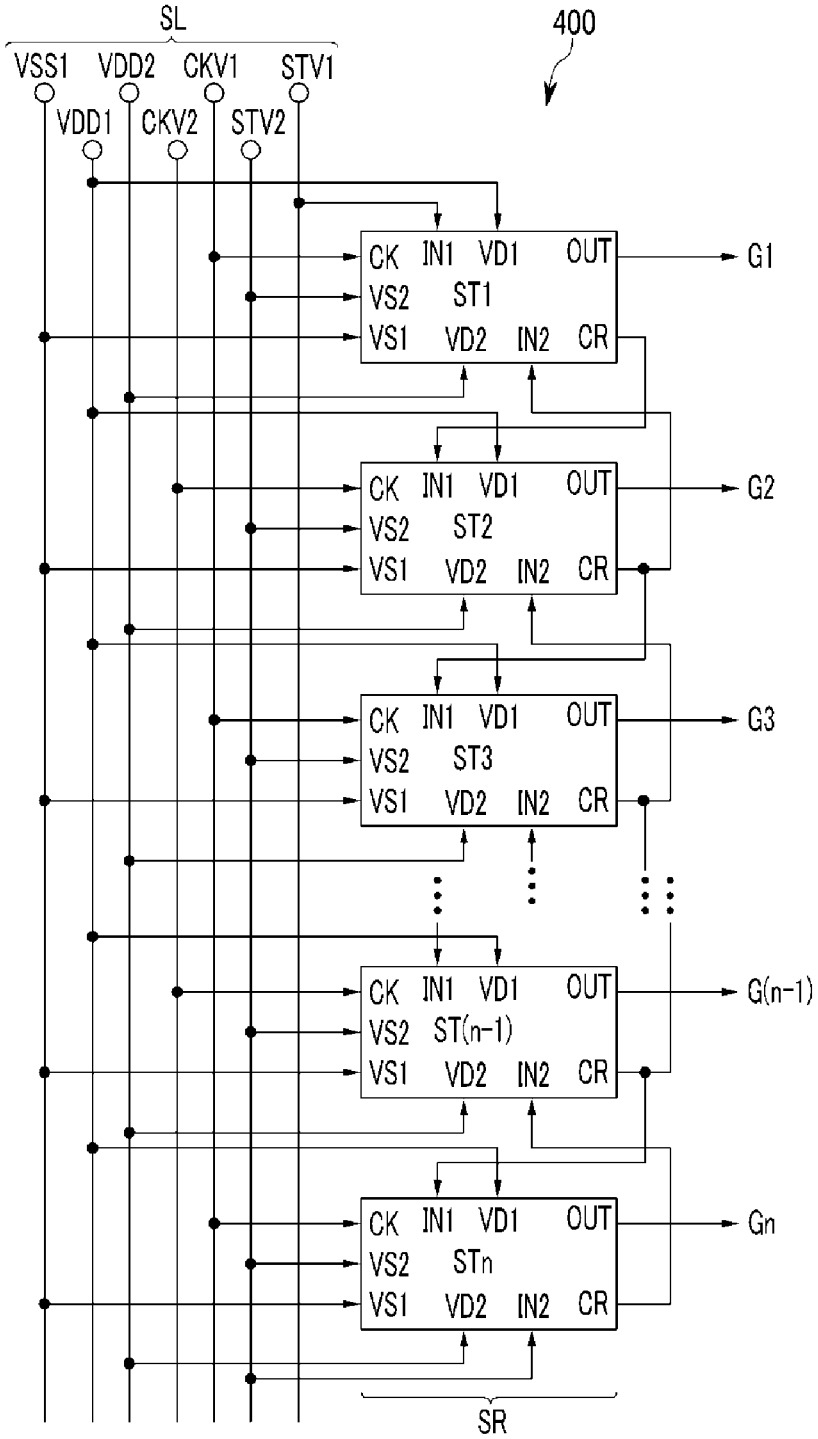
Figure 12:
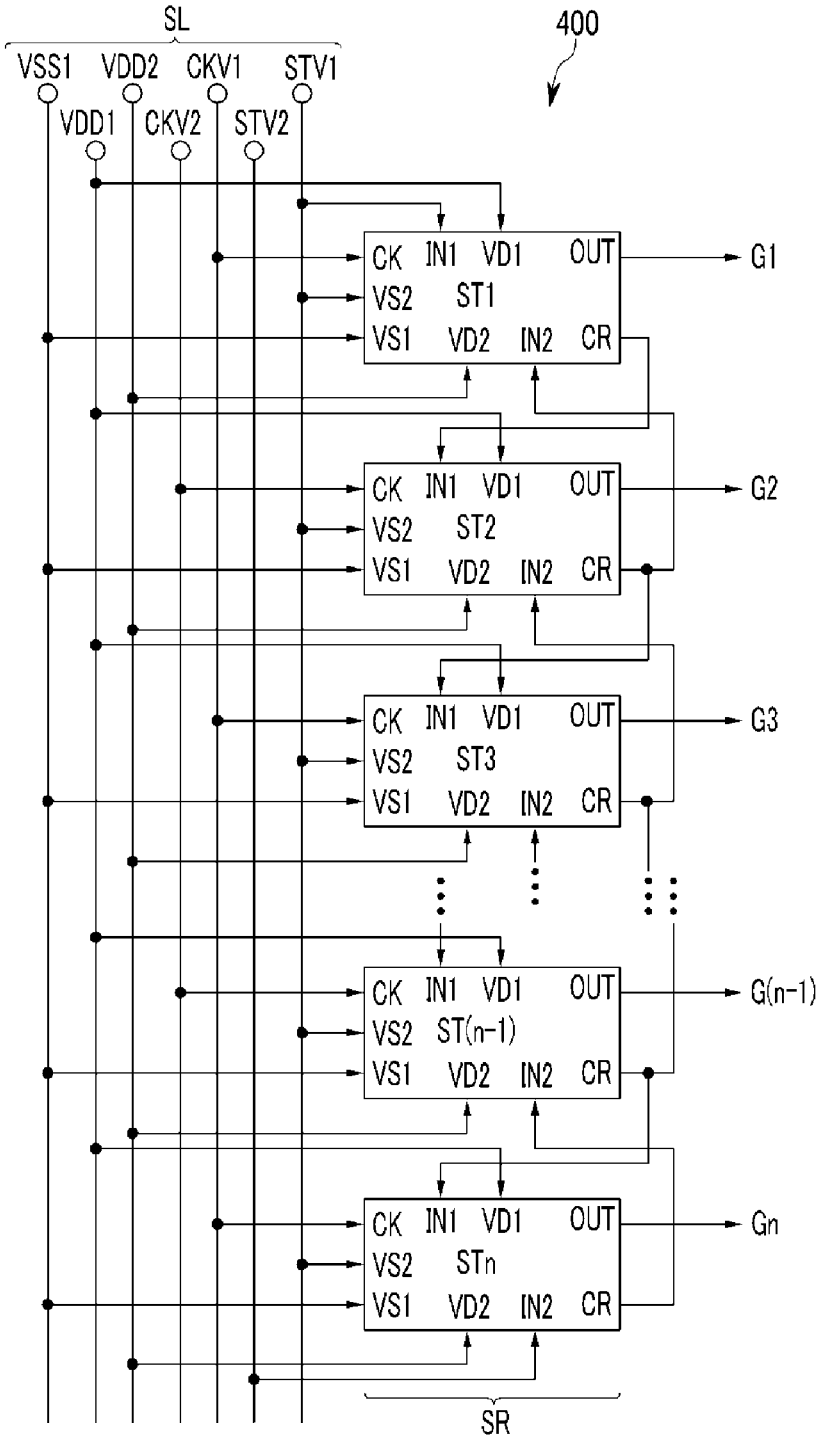
Figure 13:
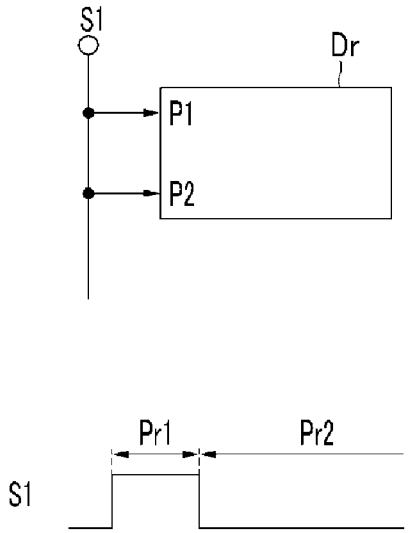
FIG. 13 is a plan view of an exemplary embodiment of a driver and a driving signal thereof according to the invention.

FIGS. 10 to 12 are block diagrams showing alternative exemplary embodiments of the scan driver according to the invention, and FIG. 13 is a plan view of an exemplary embodiment of a driver and a driving signal thereof according to the invention.

Firstly, referring to FIG. 10, the scan driver 400 is substantially the same as the scan driver 400 shown in FIGS. 3 to 5, and differences between the scan driver 400 in FIG. 10 and the exemplary embodiment shown in FIGS. 3 to 5 will be described.

The scan driver 400 in FIG. 10 does not have the line that transmits the second scanning start signal STV2, and includes a line that transmits one scanning start signal STV. The scanning start signal STV may be a signal such as the first scanning start signal STV1 shown in FIGS. 3 to 5. The scan driver 400 in FIG. 10 may be driven in one direction. In such an embodiment, the last stage STn may be reset to output the gate-off voltage Voff through an additional stage of an additional circuit element after the output of the gate-on voltage Von. The configuration and process for the reset of the last stage STn may be set according to various conventional configurations and processes for the reset of the last stage STn, and a detailed description thereof is herein omitted.

In such an embodiment, the stages ST1 to STn of the scan driver 400 further includes a low voltage terminal VS that receives the signal that determines the level of the gate-off voltage Voff of the gate signal. However, in such an embodiment, wiring to transmit the low voltage to the low voltage terminal VS of the stages ST1 to STn, for example, the gate-off voltage Voff, may be omitted. The low voltage terminal VS of the stages ST1 to STn is connected to a line that transmits the scanning start signal STV to receive the scanning start signal STV.

The scanning start signal STV has a pulse of one high level only at a time when a frame starts, similarly to the first scanning start signal STV1 shown in FIGS. 4 and 5, and maintains the gate-off voltage Voff of the low level thereafter in the frame. Accordingly, although the scanning start signal STV is input to the low voltage terminal VS of the stages ST1 to STn, the scan driving may normally progress during the frame.

The low voltage terminal VS of the stages ST1 to STn may be substantially the same as the second low voltage terminal VS2 shown in FIGS. 6 to 9.

In an exemplary embodiment, the driving signal (e.g., scanning start signal) that maintains the low level, for example, the gate-off voltage Voff, during a substantial portion of a frame is input to the low voltage terminal VS of the stages ST1 to STn of the scan driver 400 such that the number of the driving signal lines for the driving of the scan driver 400 is substantially reduced, and an area of the peripheral area of the display device is thereby substantially reduced. In such an embodiment, the low voltage level that is input to the low voltage terminal VS may be substantially the same as the low level of the driving signal, and the stages ST1 to STn may be normally operated although the driving signal is continuously applied.

Next, referring to FIGS. 11 and 12, other alternative exemplary embodiments of the scan driver 400 are substantially the same as the scan driver shown in FIGS. 6 to 9, except that the signal line that transmits the second low voltage VSS2 is omitted. In such embodiments, the second scanning start signal STV2 or the first scanning start signal STV1 may be input to the second low voltage terminal VS2 of the stages ST1 to STn. As described above, the first scanning start signal STV1 or the second scanning start signal STV2 only has the pulse of the high level when a frame starts, however the first scanning start signal STV1 or the second scanning start signal STV2 has the low level while the stages ST1 to ST2 operate, for example, the first scanning start signal STV1 or the second scanning start signal STV2 maintains the second low voltage VSS2 such that the first scanning start signal STV1 or the second scanning start signal STV2 may be input to the second low voltage terminal VS2 of the stages ST1 to STn.

Referring to FIG. 13, an exemplary embodiment of a driving circuit Dr that drives a device such as the display device includes two different input terminals, e.g., a first input terminal P1 and a second input terminal P2. The driving signal S1 is input to the first input terminal P1 and the second input terminal P2 through one driving signal line. The driving signal S1 includes the first period Pr1 and the second period Pr2 in time. The waveform of the first period Pr1 of the driving signal S1 and the waveform of the second period Pr2 may be different from each other. The sequence of the first period Pr1 and the second period Pr2 may vary.

The voltage of one period of the first period Pr1 and the second period Pr2 of the driving signal S1 input to the second input terminal P2 independent of the operation of the driving circuit Dr. In such an embodiment, for example, the driving circuit Dr may not operate while the voltage of the first period Pr1 of the driving signal S1 is input to the second input terminal P2. The voltage of the first period Pr1 of the driving signal S1 is input to the first input terminal P1 such that the driving of the driving circuit Dr starts.

In an exemplary embodiment, the driving signal that transmits the different waveforms in the different periods are simultaneously connected to two input terminals such that the number of signal lines to transmit the driving signal is substantially reduced and the structure of the driver is substantially simplified.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A scan driver, comprising:

a plurality of stages dependently connected to each other, wherein each of the plurality of stages outputs a gate signal, wherein a first scanning start signal is input to a first stage of the plurality of stages, wherein a second scanning start signal is input to a last stage of the plurality of stages, wherein each of the first scanning start signal and the second scanning start signal has a single pulse per frame, wherein the plurality of stages sequentially outputs gate-on voltages between a time when a pulse of the first scanning start signal for a frame is input to the first stage and a time when a pulse of the second scanning start signal for the frame is input to the last stage, wherein the plurality of stages outputs a first low voltage lower than the gate-on voltage after the pulse of the second scanning start signal for the frame is input to the last stage, and wherein each of the plurality of stages includes a low voltage terminal which directly receives the first scanning start signal or the second scanning start signal.

2. A scan driver comprising: a plurality of stages dependently connected to each other, wherein each of the plurality of stages includes a second terminal which directly receives a first driving signal and outputs a gate signal, wherein a first stage of the plurality of stages further includes a first terminal which directly receives the first driving signal, wherein a waveform of the first driving signal in a first period and a waveform of the first driving signal in a second period are different from each other, and wherein at least one stage of the plurality of stages operates in the second period of the first driving signal input to the second terminal and does not operate in the first period of the first driving signal, the first driving signal includes a scanning start signal having a single pulse per frame.

* * * * *